US006515622B1

(12) United States Patent
Izadpanah et al.

(10) Patent No.: US 6,515,622 B1
(45) Date of Patent: Feb. 4, 2003

(54) ULTRA-WIDEBAND PULSE COINCIDENCE BEAMFORMER

(75) Inventors: Hossein Izadpanah, Thousand Oaks, CA (US); Ronald Regis Stephens, Westlake Village, CA (US); Gregory Tangonan, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 25 days.

(21) Appl. No.: 09/593,642

(22) Filed: Jun. 13, 2000

(51) Int. Cl.[7] ..... H01Q 3/22; H01Q 3/24
(52) U.S. Cl. ..... 342/368; 342/372
(58) Field of Search ..... 342/368, 371, 342/372

(56) References Cited

U.S. PATENT DOCUMENTS

| | | | | |
|---|---|---|---|---|
| 5,389,939 A | | 2/1995 | Tang et al. | |
| 5,475,392 A | | 12/1995 | Newberg et al. | |
| 5,861,845 A | | 1/1999 | Lee et al. | |
| 5,909,460 A | | 6/1999 | Dent | 375/200 |
| 5,955,992 A | * | 9/1999 | Shattil | 342/375 |

FOREIGN PATENT DOCUMENTS

| | | |
|---|---|---|
| EP | 0 471 226 A2 | 2/1992 |
| EP | 1 134 917 A2 | 9/2001 |

OTHER PUBLICATIONS

Abstract of JP 09–138271 A (published May 27, 1997), *Patent Abstracts of Japan*, vol. 1997, No. 9, Sep. 30, 1997.

Hewlett–Packard, "Coaxial Step Recovery Diode Module (Impulse Train Generators)", Product Information, pp. 1–4.

Herotek, Inc., "Step Recovery Diode Comb (Harmonic) Generators, 0.5 to 50 GHz", Product Information, pp. 1–4.

Nakazawa, Masataka, et al., "Transform Limited Pulse Generation In The Gigahertz Region From A Gain–Switched Distributed–Feedback Laser Diode Using Spectral Windowing", *Optics Letters*, vol. 15, No. 12, Jun. 15, 1990, pp. 715–717.

NTT Electronics Corp. "NEL's Laser Diodes", Product Information, pp. 1–2.

Suzuki, Masatoshi, et al. "Transform–Limited Optical Pulse Generation up to 20–Ghz Repetition Rate by a Sinusoidally Driven InGaAsP Electroabsorption Modulator", *Journal of Lightwave Technology*, vol. 11, No. 3, Mar., 1993, pp. 468–472.

* cited by examiner

*Primary Examiner*—Theodore M. Blum
(74) *Attorney, Agent, or Firm*—Ladas & Parry

(57) ABSTRACT

An ultra-wideband beamformer is provided by using conventional phase shifting techniques to impress data and antenna scan information onto a narrow band signal. A non-linear element then converts the narrow sine wave into ultra-wideband pulses. Phase shift key modulation impresses data information onto the sine wave in the form of a phase shift. The data-bearing sine wave is split into multiple transmission lines where each provides an additional antenna scanning phase shift. The non-linear element converts each phase of the sine wave into short pulses which are sent to radiating elements for transmission. In the far-field of the beam, the scan delays between the radiating elements are canceled out, such that the fields from each radiating element are summed and the pulse position modulated data recovered.

44 Claims, 6 Drawing Sheets

ULTRA-WIDEBAND PULSE COINCIDENCE BEAMFORMER

FIELD OF THE INVENTION

This invention relates to phased array antennas, and, more particularly, to ultra-wideband phased array antennas for radio frequency and optical beam forming.

BACKGROUND OF THE INVENTION

Ultra wideband systems are known in the art as those systems that transmit and receive electro-magnetic energy over a wide frequency band where the instantaneous fractional bandwidth of the system exceeds 25%. Some of the advantages of ultra wideband (UWB) systems are: lowered probability of intercept of transmissions; reduced multipath fading and radio frequency interference problems; and enhanced target recognition performance. For transmission of UWB signals, a beamformer must be able to form and direct a beam that retains the full bandwidth of the UWB signal.

Conventional beamformers operate with instantaneous bandwidths generally less than 25%. They employ a combination of phase shifters, delay lines and antenna subaperture configurations to minimize the pulse shape distortion and beam broadening that are usually collectively referred to as "beam squint." For beam squint to be zero, the pulse envelopes emitted from each radiating element must coincide at the receiver, and the carriers (if present) must all be in phase.

The prior art for wideband and ultra wideband systems employs combinations of phase shifters, fixed non-tunable delay lines, and antenna subaperture geometries. For instantaneous fractional bandwidths close to 100%, the subaperture size needed to achieve maximum acceptable levels of beam squint approaches the radiating element spacing. That is, only one element per subaperture can be accommodated, so that the use of subapertures is no longer a meaningful tool at UWB. Systems with phase shifters setting the phase at a single frequency are also not broad-band and cannot be used in the UWB portion of a system such as at the radiating element.

The prior art discloses the use of fixed bulky delay lines as a feasible component for ultra wideband beamforming system. Such a system is disclosed by Newberg et al., in U.S. Pat. No. 5,475,392, "Frequency Translation of True Time Delay Signals," issued Dec. 12, 1995. Newberg et al. disclose providing each antenna element in a phased array with a separate frequency translated transmit signal. The frequency translated transmit signal is created by mixing a true time delayed beamsteering signal with a phase shifted or true time delayed local oscillator signal. Delay lines or other true time delay circuits are used to provide the delay required for the true time delayed beam steering signal.

However, delay lines have severe implementation problems when applied to UWB systems. Since subapertures cannot be used, a beamformer must have a dedicated delay line feeding each radiating element. This results in a large number of delay lines. Since phase shifters, inherently narrow beam devices, cannot be used, each beam scan angle must be established by a separate time-delay state. Since the scan angle separations must be on the order of a beam width for full coverage in two dimensions, many time delay states are needed for control. Thus, for an antenna with a large number of elements and/or a narrow beam, the number of delay lines and delay states required become prohibitively large. Even a moderate resolution system implemented in this way would be extremely complex and expensive.

Radio Frequency (RF) mixing feed systems such as the Heterodyning Rotman antenna as disclosed by Lee et al. in U.S. Pat. No. 5,861,845, "Wide-Band Phased Array Antennas and Methods," issued Jan. 19, 1999 can be effective at producing beams with moderate amounts of beam squint at bandwidths in the low range of UWB (i.e., bandwidths≦25%). However, at the higher bandwidths, the heterodyning scan range must be held extremely narrow in order to keep beam squint within tolerable levels. This in turn requires that a large number of true-time-delay ports (sets of physical delay lines) be used. Thus the complexity of having a large number of delay line sets and the problems of switching between them as a target is tracked become very cumbersome with such higher bandwidth UWB beamformers.

In light of the above discussion, there exists a need in the art for a squint-free, continuously scanned ultra wideband phased array antenna beamformer. A system providing such ultra wideband beams should be low cost and capable of being fabricated from off-the-shelf components.

SUMMARY OF THE INVENTION

It is an object of the present invention to provide a method and apparatus for forming ultra wideband phased array antenna beams with no beam squint. It is a further object of the present invention to provide a low cost ultra wideband beamforming system that can preferably be fabricated from off-the-shelf components.

The present invention uses phase shift key modulation to impress data information in the form of a phase shift $\Delta\Phi_D$ onto the phase of a sine wave of frequency $f_p$. The phase $\Delta\Phi_D=2\pi f_p\Delta T$ corresponds to the time delay $\Delta T$ required in a pulse position modulation format. The data-bearing sine wave is then split into N transmission lines where each undergoes an additional antenna scanning phase shift $\delta\phi_{Sn}=2\pi f_p n\delta t$, where $\delta t$ is the required inter-element time delay for scanning the antenna to angle $\theta_0$, and integer n is an index specifying the transmission line. Each line signal then passes through a non-linear element which converts the sine waves into short pulses, with each pulse appearing at a peak of the sine wave. The pulses in each line are then sent to a corresponding antenna element where they are emitted.

Pulses emitted by antenna element "n" have total delay times $T_{TOT}=\Delta T+n\delta t$ corresponding to the sum of the data and the scan angle delays. In the antenna far-field at scan angle $\theta_0$, the progressively increasing scan delays $n\delta t$ between elements are canceled out by the different propagation distances to the far-field. As a result, the electric fields from all elements during the pulse interval coincide and vector sum at the receive antenna with a common delay time $\Delta T$ corresponding to pulse position modulated data. The vector summed signal is then demodulated by the receiver and the pulse position modulation data is recovered.

The phase shifters and pulse formers of the present invention can be provided by commercial-off-the-shelf-components or other devices well known in the art. Such devices provide for creation of pulses on the order of ten to one hundred picoseconds. The antenna elements are deployed in antenna arrays also well known in the art.

One embodiment of the present invention provides an ultra-wideband beamformer for transmission of data symbols by a pulsed beam comprising: a sine wave generator; a modulator modulating the sine wave with the data symbols; a plurality of phased output paths, each providing a pulsed beam wherein each phased output path comprises: a phase shifter; a pulse former; and a radiating element.

Other embodiments of the present invention provide for modulation of data symbols by suppressing one or more phases of the generated sine wave. Sine wave suppression can also be used to encode the pulsed output provided by the system. Sine wave suppression can be performed by a separate modulation element or can be performed by the pulse former used within the invention.

Another embodiment of the present invention provides a method for forming an ultra-wideband phased array beam comprising the steps of: providing a stream of data symbols; generating a sine wave; modulating the sine wave with the stream of data symbols; providing the modulated sine wave to a plurality of phased output paths; phase shifting the modulated sine wave in each of the phased output paths to provide the delay required for a beam scan angle, said phase shifting providing a delay required to provide a beam scan angle; forming a pulse from each phase of each delayed modulated sine wave; and sending the pulse to a radiating element.

Optical beamforming is also provided by the present invention. The components used for electrical beamforming are combined with electro-optical components to provide an ultra-wideband optical beamforming system. Optical beamforming systems formed from gain switched laser diodes provide ultra-wideband systems with optical pulses as short as three picoseconds. Optical beamforming systems formed from electro-absorption modulators provide pulses as short as 10 picoseconds at up to 20 gigapulses per second.

DETAILED DESCRIPTION OF PREFERRED EMBODIMENTS

Figure 1:
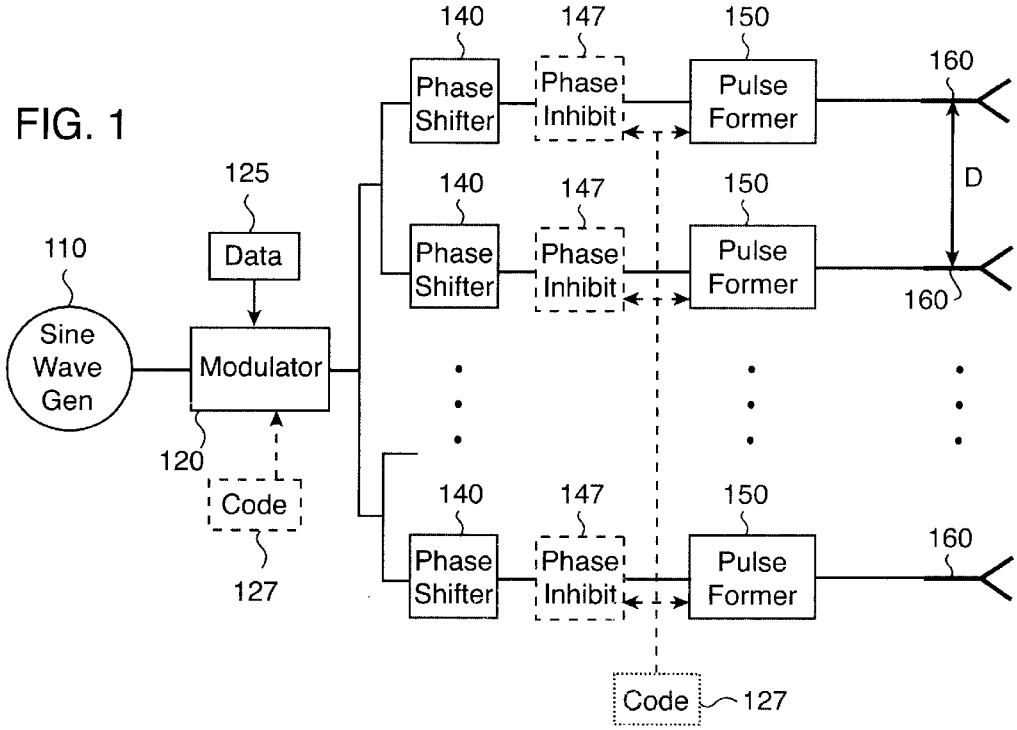
FIG. 1 is a simplified schematic of one embodiment of an ultra wideband phased array antenna system in accordance with the present invention.

A preferred embodiment of the present invention is shown in FIG. 1. Parameters used in the accompanying figures and the following discussion are defined as follows:

$\Delta T$=Time shift of the pulse position modulation data symbol $f_p$=Frequency of the pulses within each symbol $\Delta\Phi_D=2\pi f_p\Delta T$=Data phase shift of a sine wave at $f_p$ corresponding to a delay time $\Delta T$ $\delta t=(D/c)\sin\theta_0$=Antenna inter-element delay time for scan angle $\theta_0$, with D=inter-element spacing and c=speed of light.

$\delta\phi_{Sn}=2\pi f_p n\delta t$=Scan angle phase shift of sine wave at $f_p$, for element n and beam scanned to angle $\theta_0$ $f_0$=Frequency of an up-conversion carrier (if used)

As shown in FIG. 1, a sine wave generator 110 generates an electrical sine wave at a specific frequency $f_p$. Data information 125 is provided to a phase shift modulator 120 which provides phase shift key modulation to impress the data information 125 in the form of a phase shift $\Delta\Phi_D$ onto the phase of a sine wave of frequency $f_p$. The phase $\Delta\Phi_D=2\pi f_p\Delta T$ corresponds to the time shift $\Delta T$ required to position a pulse in time in the pulse position modulation format. In Two Phase Shift Keying modulation, which is also known as Binary Phase Shift Keying (BPSK) modulation, only two states, 0 and $\Delta T$, are required. For other orders of Phase Shift Keying (e.g. Quaternary Phase Shift Keying, 8 Phase Shift Keying, etc.) additional $\Delta T$ states would be defined. The phase shift modulated sine wave is then split into N copies and directed into phased output paths containing transmission lines 130, phase shifters 140, pulse formers 150, and radiating elements 160.

The modulated sine waves in each transmission line 130 are provided to electronic phase shifters 140. To simplify the phase shift required and to maintain ultra wideband signal characteristics, the path length from the modulator to each phase shifter should be the same. Hence, the transmission lines 130 should preferably be of equal length. If the transmission lines are of unequal length, then the transmission lines should preferably include wideband time delay elements that ensure that the time delay encountered by the phase shift modulated sine waves in each output path is the same prior to the electronic phase shifters 140. To implement antenna scan, the signal from each transmission line 130 undergoes an antenna scanning phase shift provided by the electronic phase shifters 140 of $\delta\phi_{Sn}=2\pi f_p n\delta t$, where $\delta t$ is the required inter-element time delay for scanning the antenna to angle $\theta_0$ and integer n is an index number specifying the transmission line. Hence, each electronic phase shifter 140 provides a different phase shift. Since the signal bandwidth is still relatively narrow, conventional electronic phase shifters well known in the art can be used with no beam degradation.

As indicated above, each electronic phase shifter is set to a prescribed phase delay for a given antenna scan angle and transmission line. The phase delays can be pre-calculated, allowing a matrix of phase shift values to be stored in a memory, such that a look-up table can be used to determine the phase shift required for each phase shifter for a specified scan angle. Depending upon the required angular resolution and angle, discrete phase shifts can be realized using digital or analog phase shifters. Such phase shifters are well known in the art and are available as commercial-off-the-shelf items.

The output of each electronic phase shifter 140 is coupled into a pulse former 150. The pulse former 150 contains a non-linear element which converts each half-cycle of the modulated sine wave into a single short pulse where each pulse corresponds to a single unique phase of the sine wave and appears at a unique temporal position. Examples of specific non-linear elements are discussed below, but the present invention is not limited to those examples. The pulses output by each pulse former 150 are then sent to a corresponding radiating element 160, such as an element of an antenna array, where they are radiated as a single beam. Preferably, equal length transmission lines are used to couple the outputs of the pulse formers to the radiating elements so as to ensure the ultra wideband characteristics of the radiated beam. The radiating elements are contained in array configurations well known in the art.

Pulses emitted by each radiating element 160 have total delay times $\Delta T+n\delta t$ corresponding to the data and the scan angle delays. In the antenna far-field at scan angle $\theta_0$, the progressively increasing delays $n\delta t$ between elements disappear due to the propagation geometry, and the electric fields from all elements coincide and vector sum at the receive antenna with a common delay time $\Delta T$. Since there is perfect pulse coincidence, there is no beam squint.

Figures 2A, 2B, 2C, 2D:
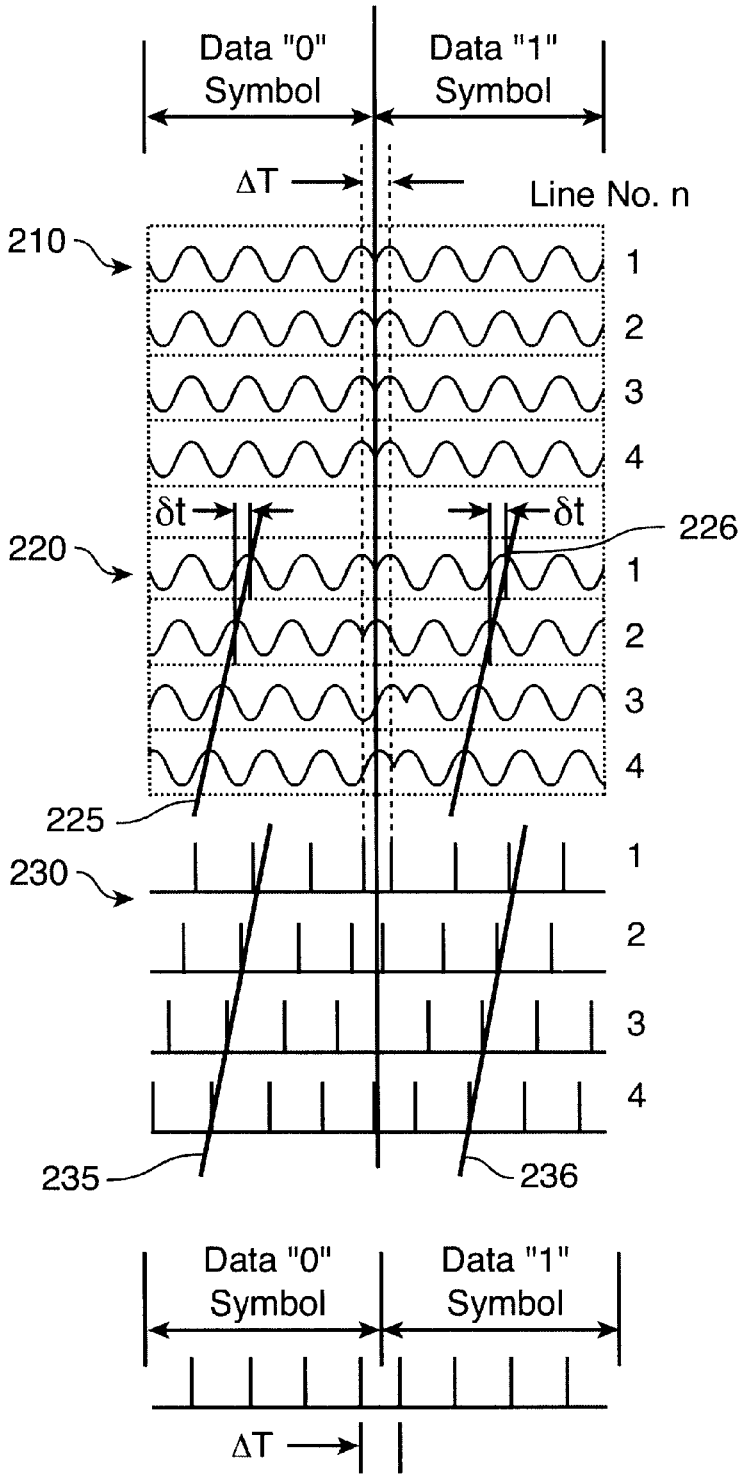
FIG. 2A illustrates a Binary Phase Shift Key (BPSK) modulated signal used in an embodiment of the present invention.
FIG. 2B illustrates a BPSK signal after an antenna scan phase shift is applied in an embodiment of the present invention.
FIG. 2C illustrates pulse position timing formed from a BPSK signal in an embodiment of the present invention.
FIG. 2D illustrates N coincident pulses received after transmission from a phased array antenna in accordance with the present invention.

FIGS. 2A–2D illustrate an example of the signal processing carried out by the present invention. In the example illustrated by FIGS. 2A–2D, Binary Phase Shift Keying modulation is used with multiple pulses in each data symbol. Four pulses per data symbol are shown only as an example, since the present invention accommodates any number of pulses per symbol. As an example, the antenna array shown in FIGS. 2A–2D comprises four antenna elements and four signal lines, but the system provided by the present invention may use any number of antenna elements and signal lines. FIG. 2A illustrates waveforms after phase shift modulation and distribution to the preferably equal length transmission lines. FIG. 2B illustrates the waveforms after antenna scan phase shifting. FIG. 2C illustrates the waveforms after pulse formation. FIG. 2D illustrates the waveform of the received signal.

In FIG. 2A, four data encoded sine waves 210 in BPSK modulated format are shown. The data symbol "1" is phase shifted by 180 degrees relative to the data symbol for "0", and all four lines carry identically time dependent sine wave segments. The 180 degree phase shift corresponds to a time delay $\Delta T$.

FIG. 2B shows the results of antenna scan phase shifting. Each line signal 220 is phase shifted to progressively higher phases, with the corresponding inter-element delay time being $\delta t$. The progressive phase and increasing delay time are indicated by the tilted lines 225, 226 which pass through corresponding crests of the sine wave signals.

FIG. 2C shows a train of short pulses 230 produced by the pulse former at the crests of each sine wave. The $\Delta T=n\delta t$ time delays present in the sine waves shown in FIG. 2B are carried over to the pulse position timing in FIG. 2C. These delays are represented by the tilted lines 235, 236 which pass through corresponding pulses. The pulses in FIG. 2C can easily be of sub-nanosecond duration, for example, 100 picoseconds or less. The conversion of sine waves into pulses thus dramatically increases the bandwidth while maintaining the data and antenna angle information intact.

The coincidence of the four pulse symbols emitted by the four antenna elements and summed into a single signal at a receive antenna is shown in FIG. 2D. The symbols are recovered with a time delay $\Delta T$ between a "1" and a "0" corresponding to the pulse position modulation format by simple conventional BPSK demodulation techniques known in the art.

Figure 3A:
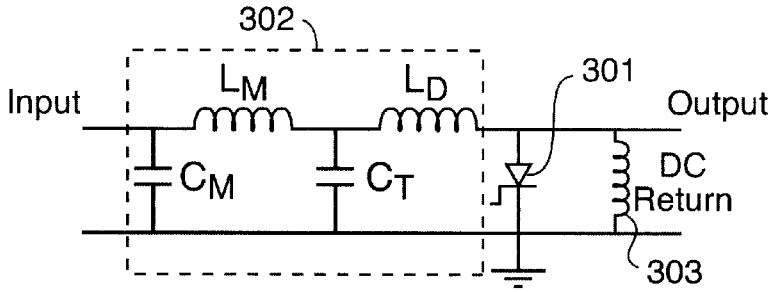
FIG. 3A is a simplified schematic of a commercial device used for narrow electrical pulse formation from a sine wave.
Figure 3B:
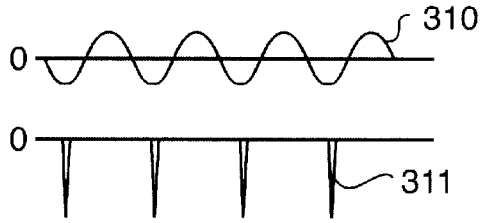
FIG. 3B illustrates the conversion of a sine wave into a pulse train by the commercial device shown in FIG. 3A.

An example of an electrical pulse former using a step recovery diode is shown in FIG. 3A. The schematic shown in FIG. 3A is that of a commercial device designed as a comb frequency generator, but used in the present invention as a pulse former. Such commercial devices are the Hewlett Packard33005 Coaxial Step Recovery Diode Module and the Herotek GC2050A Step Recovery Diode Comb Generator. As shown in FIG. 3A, the step recovery diode 301 is packaged with an input filtering circuit 302 and an output filtering circuit 303 which serve to eliminate the background signal outside of each continuous wave cycle, to enhance the sharpness of the pulse and to remove any direct current component. Pulses of a duration of a few tens of picoseconds can easily be produced at GHz frequencies. In FIG. 3B, the waveforms shown are for excitation with a sine wave 310. The step recovery diode is preferably mounted with its p side grounded, so that the pulses 311 preferably appear at a trough in the sine wave 310 instead of a crest. Step recovery diode units such as these are inexpensive and are simply inserted into the coaxial cable feedlines to the antenna elements. Bias signals applied to the diode may be used to inhibit selected pulses in order to encode the data symbols or to modulate data onto the pulse stream, as well.

Other embodiments of the present invention support the use of any number of pulses per data symbol, e.g. 1, 8, 100, 1000, etc. Since each pulse is derived from a period of the sine wave, the phase shift modulator may apply the phase shift associated with a symbol to a single phase of the sine wave or to multiple phases of the sine wave. If multiple phases of the sine wave are phase shift encoded for a symbol, the system will output multiple pulses for that symbol. Increased numbers of pulses in each symbol can be used to increase data redundancy and increased integration time which assists in receiver synchronization and in reduced bit error rate.

As mentioned previously, the present invention may provide for the use of higher orders of phase shift keying beyond Binary Phase Shift Keying. In higher orders of phase shift keying, multiple phase shifts are applied by the phase shift modulator to represent each group of data symbols. For example in Quaternary Phase Shift Keying (QPSK), the data symbol group "00" may be represented by a 0 degree phase shift, the group "01" by a 90 degree phase shift, the group "10" by a 180 degree phase shift, and the group "11" by a 270 degree phase shift. These phase shifts would create a corresponding time delay in the pulses created by the pulse former. Use of higher orders of phase shift keying provides lower bandwidth requirements for the transmitted signal. Of course, combinations of higher order phase shift keying and multiple pulses per data symbol group may also be implemented by alternative embodiments of the present invention.

The data symbols themselves can also be encoded by nulling out selected pulses within the symbols. Such nulling allows the use of codes, such as a Barker code or any pseudorandom sequence, to represent data symbols. Nulling can be done by reducing the amplitude of selected crests of the sine waves so that they are below the non-linear threshold and thus do not produce pulses. FIG. 1 shows that code information 127 can be inserted by nulling or inhibiting the phases of the sine wave at the modulator 120. FIG. 1 shows, as an alternative, that the code information 127 can be used to control the bias signals of the pulse formers 150 to inhibit phases of the sine wave. An additional alternative shown in FIG. 1 is that the code information can be used to control separate phase inhibitors 147 in each phased output path. Encoding the symbols can assist in "tagging" radar returns or in facilitating multiple users within the same band where each user is assigned a unique code.

Figure 5:
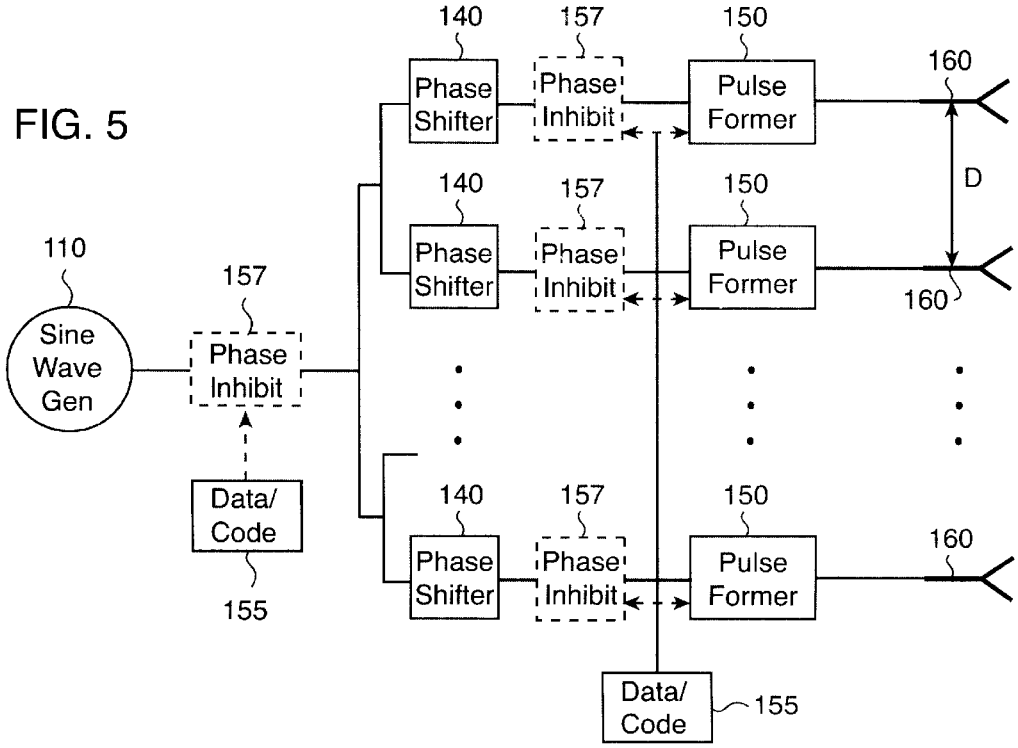
FIG. 5 is a block diagram of an embodiment of the present invention in which phase inhibitors are used to modulate data before transmission.

FIG. 5 shows an alternative embodiment of the present invention which does not rely upon the original data being presented in pulse position modulation format. Instead, the data 155 is provided as an equal interval binary stream with the presence of a pulse equaling a "1" and the absence equaling a "0". In this embodiment, the phase shift key modulator is replaced by a phase inhibiter 157 that creates an inhibiting signal based on the presence or absence of a data pulse that reduces the sine wave crest to below the pulse formation threshold (on/off keying). The antenna scan delays $\delta t$ are still applied with phase shifters. In FIG. 5, modulation of the binary stream onto the sine wave can be performed after the signal generator by the phase inhibiter 157. Alternatively, the sine wave can pass unmodulated to the phase shifters. The binary stream can then be modulated by separate sine wave inhibitors 157 after each phase shifter. FIG. 5 shows an additional alternative where the binary signal controls each pulse former so as to inhibit pulses based upon the absence of a signal in the binary stream. As previously discussed, phase inhibition may also be used to encode the pulses output by the beamformer.

Figure 6:
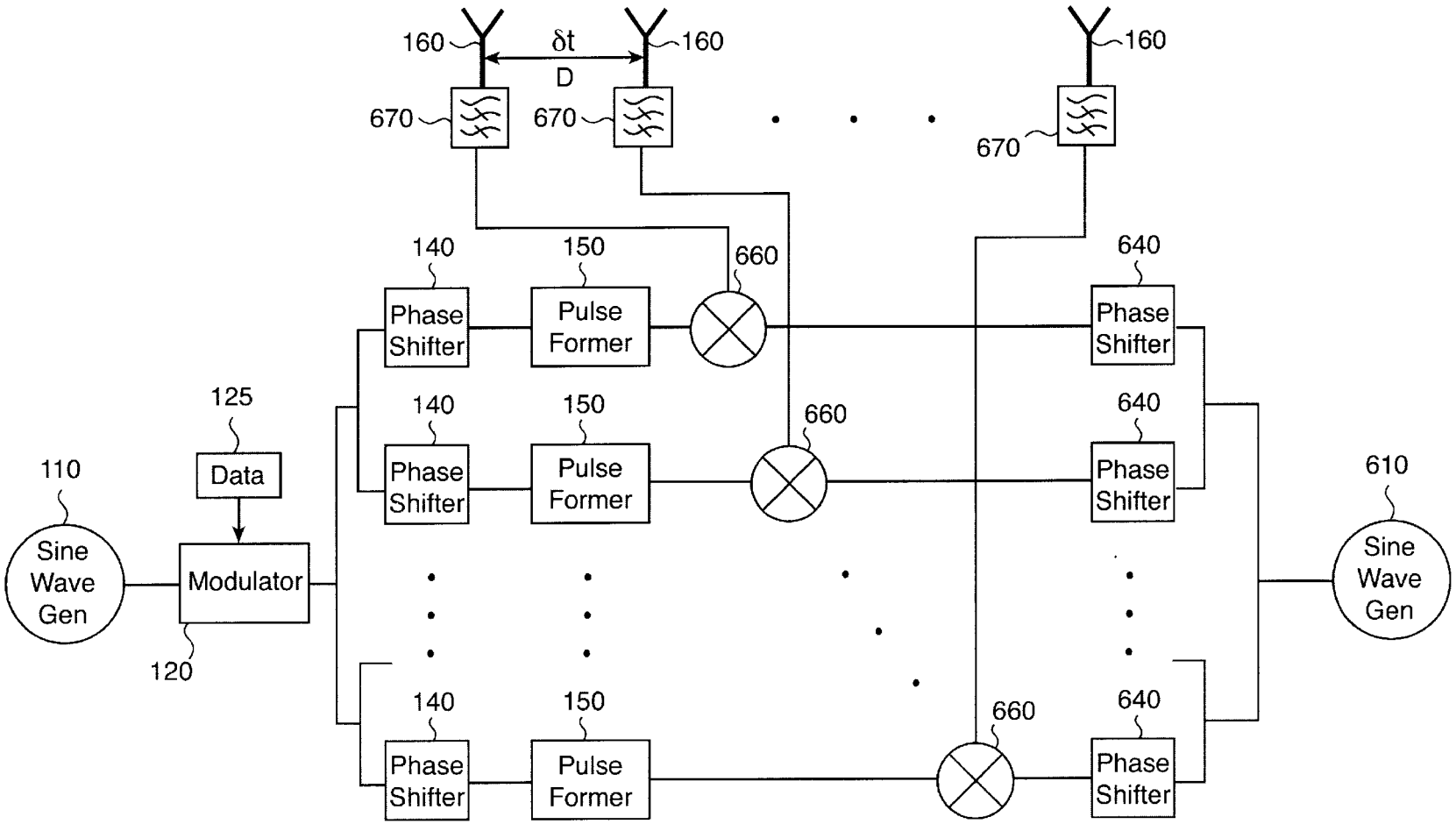
FIG. 6 is a simplified schematic of an embodiment of an ultra wideband phased array antenna system in accordance with the present invention where a baseband signal is upconverted.

Still another embodiment of the present invention allows for baseband signals to be up-converted to higher frequencies by the insertion of a carrier frequency $f_0$ using mixing techniques well known in the art. The mixing method can be electronic or photonic. FIG. 6 is a block diagram of an embodiment of the present invention where RF upconversion is used. For example, this embodiment of the present invention method might convert a 5 GHz wide baseband signal (200 picosecond pulses) to a signal centered at $f_0$=20 GHz with upper and lower sidebands each 5 GHz wide. This upconversion method is an adaptation of the downconversion method described by Newberg et al. in U.S. Pat. No. 5,475,392, previously discussed, without requiring the use of true time delay elements.

As shown in FIG. 6, a sine wave generator 610 generates a carrier sine wave at a carrier frequency $f_0$. This carrier sine wave is then sent to phase shifters 640 to implement the desired antenna scan and which correspond to the phase shifters 140 used to apply antenna scan for the data signal. Hence, each carrier signal will be phase shifted by $\phi_n=2nf_0n\delta t$. The baseband pulses with time delays $\Delta T+n\delta t$ are then mixed line by line by mixers 660 with the phase shifted carrier signals. Filtering elements 670 may be used after the mixers 660 to remove spurious signals. The mixed signals are then directed to radiating elements 160 for transmission.

The phase shift of the carrier signals ensures that after mixing, each pulse envelope has carrier cycles within it that are in phase with the carriers within the pulse envelopes on all the other lines. This will be true even though the lines all have a different $n\delta t$ delay. When the pulse modulated carriers are emitted from the radiating elements 160 and propagate to the far field, the $n\delta t$ delays are removed. But since the carriers are all in phase within the pulses, the pulse envelopes will coincide perfectly and the carriers will all sum in phase. Thus the upconverted received beam will exhibit no beam squint.

Figure 7:
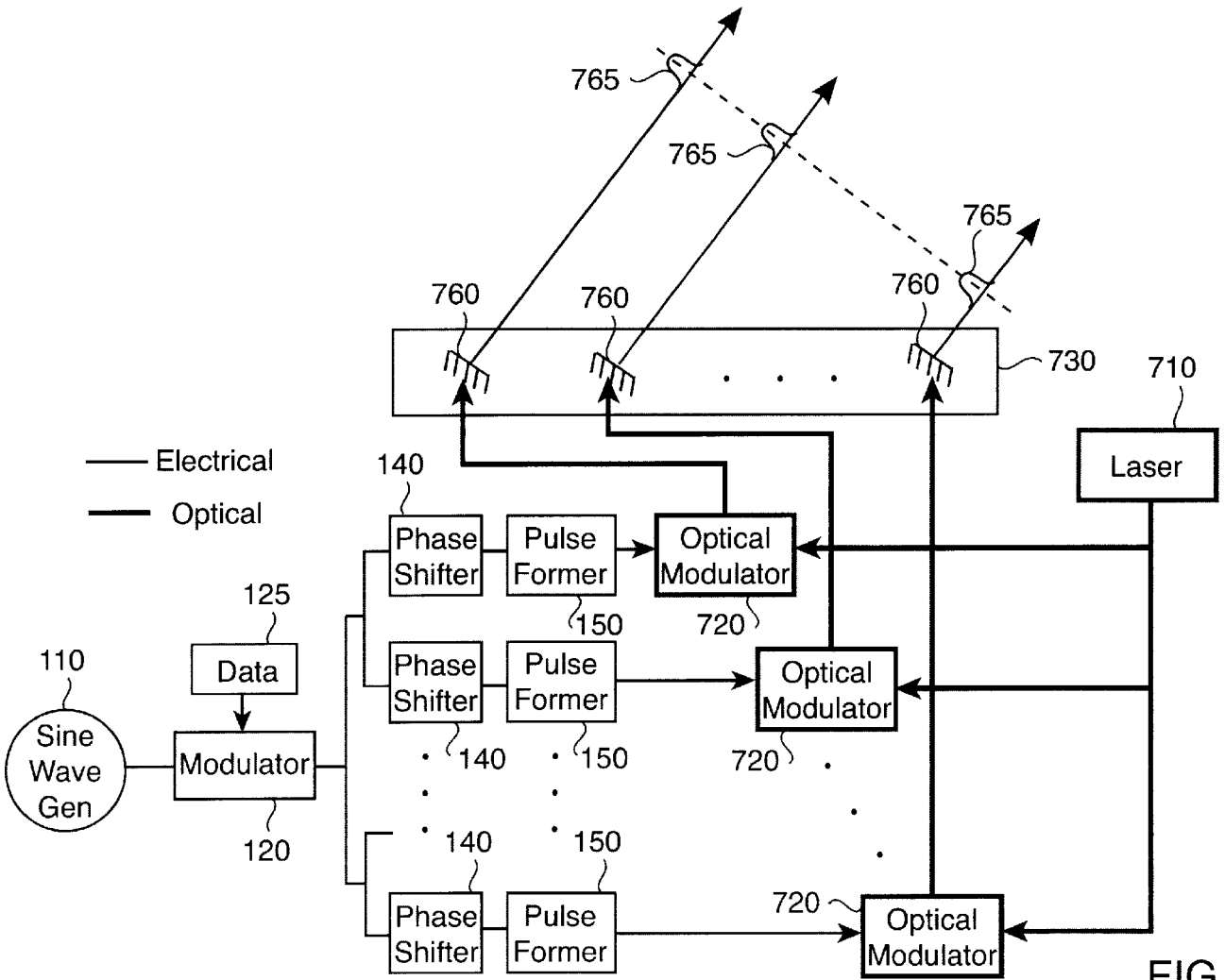
FIG. 7 is a block diagram for an optical beamformer in accordance with the present invention.

The previous discussion primarily addressed the formation of radio frequency electro-magnetic beams, but alternative embodiments of the present invention are used for optical beam forming. A preferred embodiment of an optical beamformer in accordance with the present invention is shown in FIG. 7. The optical beamformer comprises the electrical components previously described for electrical beamformer and electro-optical components required for generating and manipulating optical signals. Hence, many of the commercial components used by the radio-frequency beam forming embodiments of the present invention may also be used in the optical beamforming embodiments of the present invention.

The electrical components of the optical beamformer include the sine wave generator 110, modulator 120, antenna scan phase shifters 140, and pulse formers 150 as previously discussed In the optical beamformer, the sine wave generator 110 is typically operated at 1 GHz or higher. The antenna scan phase shifters 140 previously described provide the required phase shifts for steering an optical beam.

The electro-optical components of the optical beamformer include a continuous wave laser source 710, an array of optical modulators 720 and an optical beam steering array 730. The output from each pulse former 150 is provided to an optical amplitude modulator 720 which gates a continuous wave laser beam into an array of temporal sequenced pulses. The optical amplitude modulators 720 can be in the form of monolithic electro-absorption multiple quantum well devices or electro-optic wave guide modulators. The parallel stream of delayed optical pulses is directed to optical radiating elements 760 within an optical beam steering array 730. The optical radiating elements 760 radiate the parallel stream of optical pulses into the optical beam steering array which reflects or diffracts the pulses 765 within the ultra wideband optical beam. An optical microelectromechanical system structure may be used to provide the optical beam steering array 730.

Figure 8:
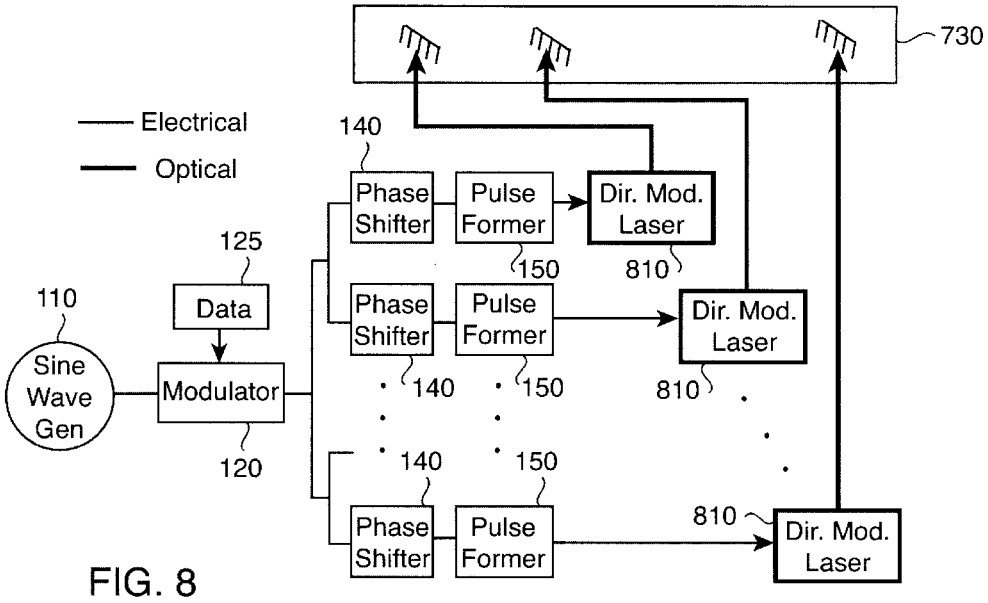
FIG. 8 is a block diagram for an optical beamformer in accordance with the present invention using direct modulated semiconductor lasers.

Multiple high-speed gain switched laser diodes are used in an alternative embodiment of the optical beamformer of the present invention as shown in FIG. 8. In this embodiment, a single laser is not used to provide a continuous wave optical signal to the array of optical modulators. Instead, each optical modulator comprises a directly modulated laser diode 810. Such devices are known in the art and have been shown to provide optical pulses with durations between 3 and 10 picoseconds at up to 15 gigapulses per second. See Nakazawa et al., "Transform-Limited Pulse Generation in the Gigahertz Region from a Gain-Switched Distributed-Feedback Laser Diode Using Spectral Windowing," Optics Letters, Vol. 15, No. 12, pp. 715–717. The output of the directly modulated laser diode 810 is controlled by the output from the electrical pulse former 150. However, directly modulated laser diodes devices require additional pulse compression stages and optical filtering for further pulse width reduction.

Figure 4A:
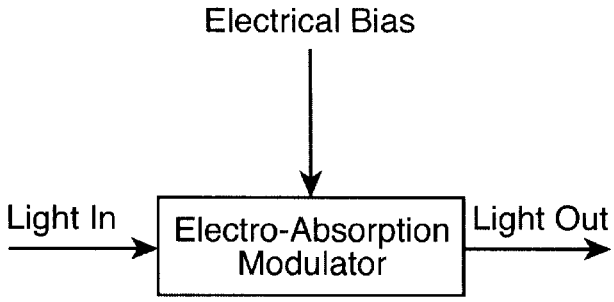
FIG. 4A is a block diagram of a device for pulse formation of optical pulses.
Figure 4B:
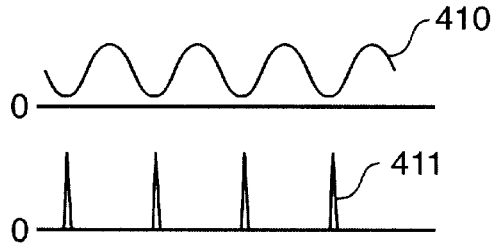
FIG. 4B illustrates the conversion of a continuous wave optical signal into an optical pulse train by the device shown in FIG. 4A.
Figure 9:
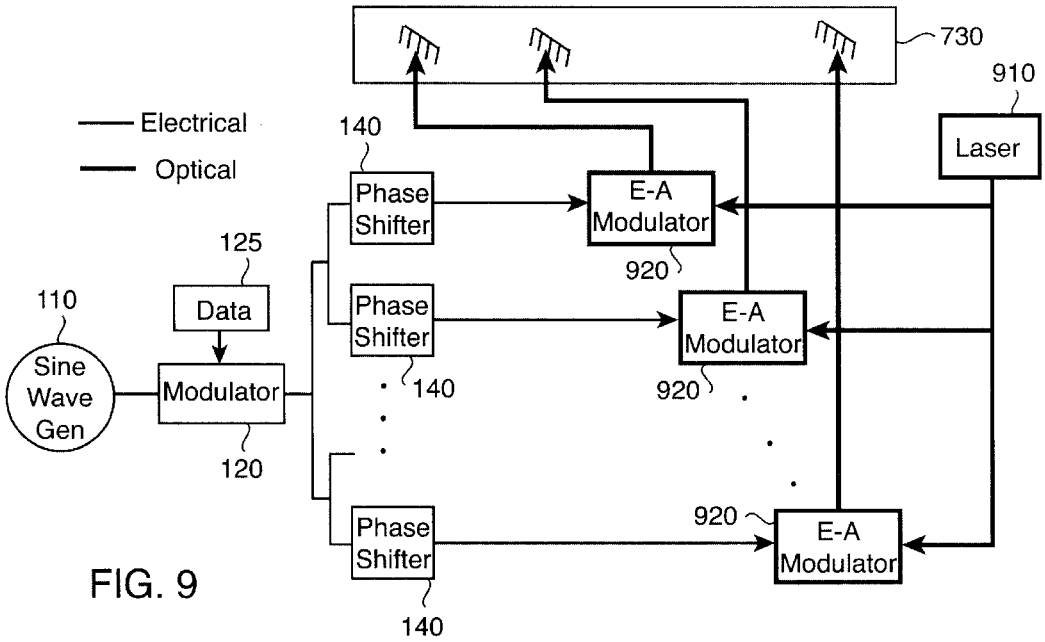
FIG. 9 is a block diagram for an optical beamformer in accordance with the present invention using electro-absorption modulators.

Another embodiment of optical beamformer provided by the present invention is shown in FIG. 9. In the embodiment shown in FIG. 9, the optical modulator 920 performs both modulation of the electrical signal onto the optical signal and the creation of optical pulses from each phase of the electrical signal. Hence, an electrical pulse former is not required. The optical modulator of this embodiment may be provided by the nonlinear Electro-Absorption Modulator (EAM) shown in FIG. 4A. FIG. 4B shows the resulting output from the EAM where the electrical signal 410 controls an electrical bias of the EAM to produce an optical pulse 411 at each crest of the sine wave in the electrical signal 410. The EAM is a well-known device that generates low chirp transform limited optical pulses with narrow band sinusoidal drive without the need for any optical resonator. A pulse compression effect is provided by the nonlinear attenuation characteristics of the EAM when driven by a continuous wave laser and BPSK electrical signal. Near transform limited pulses as narrow as 10 picoseconds have been generated at 2, 5, 10, and 20 gigapulses per second. M. Nakazawa, et al., Opt. Lett. Vol 15, pp 715–717, 1990, discloses methods for the generation of such short pulses.

As in the case of the electrical beamformer, data signals output by the optical beamformer can be encoded. Encoding can be provided by the electrical mechanisms previously described. Additionally, the EAM electrical bias signal could be made time dependent so that certain pulses are inhibited for digital on/off data modulation. This capability could also be used for data symbol encoding.

From the foregoing description, it will be apparent that the present invention has a number of advantages, some of which have been described above, and others of which are inherent in the embodiments of the invention described above. Also, it will be understood that modifications can be made to ultra wideband beamformer and the method for forming ultra wideband beams described above without departing from the teachings of subject matter described herein. As such, the invention is not to be limited to the described embodiments except as required by the appended claims.

What is claimed is:

1. An ultra-wideband beamformer for transmission of data symbols by a pulsed beam comprising:

a sine wave generator generating a sine wave at a first frequency;

a modulator providing a modulated sine wave by modulating said sine wave with said data symbols;

a plurality of phased output paths, said plurality of phased output paths providing a pulsed beam wherein each phased output path comprises:

a phase shifter receiving said modulated sine wave;

a pulse former coupled to said phase shifter; and a radiating element coupled to said pulse former.

2. An ultra-wideband beamformer according to claim 1 wherein each phased output path further comprises:

a feedline coupling said modulator to said phase shifter, said feedline having a length, wherein the lengths of said feedlines in each of said phased output paths are generally equal.

3. An ultra-wideband beamformer according to claim 1 wherein each phased output path further comprises:

a transmission line coupling said pulse former to said radiating element, said transmission line having a length, wherein the lengths of said transmission lines in each of said phased output paths are generally equal.

4. An ultra-wideband beamformer according to claim 1 wherein said radiating element is an antenna element in an antenna array.

5. An ultra-wideband beamformer according to claim 1 wherein said pulse former is an electrical pulse former comprising:

an input filter;

a step recovery diode coupled to said input filter; and an output filter.

6. An ultra-wideband beamformer according to claim 1 wherein said phase shifter is an electronic phase shifter.

7. An ultra-wideband beamformer according to claim 1 wherein said modulator is a phase shift key modulator.

8. An ultra-wideband beamformer according to claim 7 wherein said phase shift key modulator modulates a single phase of said sine wave for each one of said data symbols.

9. An ultra-wideband beamformer according to claim 7 wherein said phase shift key modulator modulates a plurality of phases of said sine wave for each one of said data symbols.

10. An ultra-wideband beamformer according to claim 1 further comprising a data encoding means for encoding each data symbol in said pulsed beam.

11. An ultra-wideband beamformer according to claim 10 wherein said data encoding means comprises:

a sine wave inhibiter, said sine wave inhibiter lowering an amplitude of one or more phases of said sine wave so as to encode each one of said data symbols.

12. An ultra-wideband beamformer according to claim 10 wherein said data encoding means comprises:

a bias signal applied to said pulse former, said bias signal inhibiting pulse generation by said pulse former.

13. An ultra-wideband beamformer according to claim 10 wherein said data symbols are encoded with a pseudo-random code.

14. An ultra-wideband beamformer according to claim 10 wherein said data symbols are encoded with a Barker code.

15. An ultra-wideband beamformer according to claim 1 wherein said data symbols are binary data symbols and said modulator comprises a sine wave inhibiter, said sine wave inhibiter lowering an amplitude of one or more phases of said sine wave based on the value of each one of said binary data symbols.

16. An ultra-wideband beamformer according to claim 1 wherein said data symbols are binary data symbols and said modulator comprises a plurality of sine wave inhibitors, wherein each phased output path further comprises a sine wave inhibiter lowering an amplitude of one or more phases of said sine wave based on the value of each one of said binary data symbols.

17. An ultra-wideband beamformer according to claim 1 further comprising:

a carrier wave generator generating a carrier sine wave at a second frequency, and wherein each of said phased output paths further comprise:

a carrier phase shifter, said carrier phase shifter receiving said carrier sine wave; and an upconverter, said upconverter having a first input coupled to said pulse former, having a second input coupled to said carrier phase shifter, and having an output, said output comprising a product of the first input mixed with the second input; said output coupled to said radiating element.

18. An ultra-wideband beamformer according to claim 17 wherein said carrier phase shifter is an electronic phase shifter.

19. An ultra-wideband beamformer according to claim 1 further comprising:

a laser generating a continuous wave optical signal;

a plurality of optical modulators; and an optical beam steering array, wherein each one of said phased output paths further comprises an optical modulator of said plurality of optical modulators, each optical modulator having a first input receiving a signal from said pulse former, having a second input receiving said continuous wave optical signal, and having a pulsed optical output coupled to said radiating element, said radiating element radiating said pulsed optical output to said optical beam steering array.

20. An ultra-wideband beamformer according to claim 1 further comprising:

a plurality of gain switched laser diodes; and an optical beam steering array, wherein each one of said phased output paths further comprises a gain switched laser diode of said plurality of gain switched laser diodes, each gain switched laser diode having an input receiving a signal from said pulse former and having a pulsed optical output coupled to said radiating element, said radiating element radiating said pulsed optical output to said optical beam steering array.

21. An ultra-wideband beamformer according to claim 1 further comprising:

a laser generating a continuous wave optical signal, and an optical beam steering array, wherein said pulse former has a first input receiving a signal from said phase shifter, has a second input receiving said continuous wave optical signal and has a pulsed optical output coupled to said radiating element, said radiating element radiating said pulsed optical output to said optical beam steering array.

22. An ultra-wideband beamformer according to claim 21 wherein said pulse former is an electro-absorption modulator.

23. The ultra-wideband beamformer of claim 1, wherein said sine wave generator comprises an electric sine wave generator generating an electric sine wave.

24. The ultra-wideband beamformer of claim 1, wherein said pulse shifter produces a phase-delayed sine wave and said pulse former converts a half-cycle of each cycle of said phase-delayed sine waver into a pulse.

25. A method for forming an ultra-wideband phased array beam comprising the steps of:

providing a stream of data symbols;

generating a sine wave at a first frequency;

modulating said sine wave with said stream of data symbols to provide a modulated sine wave;

providing said modulated sine wave to a plurality of phased output paths;

phase shifting said modulated sine wave in each of said phased output paths, said phase shifting providing a delay required to provide a beam scan angle;

forming a pulse from each phase of said modulated sine wave in each phased output path; and sending said pulse to a radiating element.

26. A method according to claim 25 wherein said data symbols are pulse position modulated data symbols.

27. A method according to claim 25 wherein:

said step of modulating said sine wave is provided by Phase Shift Key modulating said baseband sine wave with said data symbols.

28. The method according to claim 25 wherein said data symbols are binary data symbols and said step of modulating said sine wave is provided by suppressing one or more phases of said sine wave according to a value of each one of said binary data symbols.

29. A method according to claim 25 wherein:

said pulse represents one or more data symbols of said stream of data symbols.

30. A method according to claim 25 wherein:

each data symbol within said stream of data symbols is represented by a plurality of pulses formed from a plurality of phases of said modulated sine wave.

31. A method according to claim 30 further comprising the step of:

suppressing one or more pulses in said plurality of pulses to as to encode each data symbol.

32. A method according to claim 31 wherein each data symbol is encoded with a pseudorandom code.

33. The method according to claim 31 wherein each data symbol is encoded with a Barker code.

34. The method according to claim 25 further comprising the steps of:

generating a carrier sine wave at a second frequency;

providing said carrier sine wave to a plurality of carrier wave paths;

phase shifting said carrier sine wave in each carrier wave path to provide a delayed carrier sine wave in each carrier wave path, said phase shifting in each carrier wave path corresponding to the phase shifting performed in each phased output path;

mixing said delayed carrier sine wave from each carrier wave path with the pulse from a corresponding phased output path to provide an upconverted pulse; and sending said upconverted pulse to said radiating element.

35. The method according to claim 25 further comprising the steps of:

generating a continuous wave optical signal;

providing said continuous wave optical signal to a plurality of optical paths;

modulating said continuous wave optical signal in each optical path with the pulse from a corresponding phased output path to provide an optical pulse; and sending said optical pulse to said radiating element.

36. The method according to claim 25 wherein the step of forming a pulse comprises forming an optical pulse from each phase of said modulated sine wave in each phased output path.

37. The method according to claim 25 wherein the step of forming a pulse comprises:

forming a electrical pulse from each phase of said modulated sine wave in each phased output path, and generating an optical pulse by controlling a directly modulated laser with said electrical pulse.

38. The method of claim 25, wherein said sine wave at said first frequency comprises an electric since wave.

39. A beamforming apparatus comprising:

means for generating a sine wave at a first frequency;

modulation means, said modulation means receiving said sine wave and producing a modulated sine wave; and a plurality of output path means, said plurality of output path means receiving said modulated sine wave and producing a plurality of pulsed beam outputs, each output path means of said plurality of output path means comprising:

phase shifting means, said phase shifting means receiving said modulated sine wave and producing a phase-shifted sine wave;

pulse forming means, said pulse forming means receiving said phase-shifted sine wave and producing a pulse output; and radiating means, said radiating means receiving said pulse output and producing at least one pulsed beam output of said plurality of pulsed beam outputs.

40. The beamforming apparatus of claim 39, wherein said modulation means receives data symbols and modulates said sine wave with said data symbols to produce said modulated sine wave.

41. The beamforming apparatus of claim 40 further comprising a data encoding means for encoding said data symbols in said modulated sine wave or in said phase-shifted sine wave.

42. The beamforming apparatus of claim 39, wherein said means for generating a sine wave generates an electric sine wave.

43. The beamforming apparatus of claim 39, wherein said pulse forming means produces a pluse for each cycle of said phase-shifted sine wave.

44. The beamforming apparatus of claim 39, wherein said modulation means produces a phase shift key modulated sine wave.

* * * * *